United States Patent [19]

Lohausen

[11] Patent Number: 4,469,159

[45] Date of Patent: Sep. 4, 1984

[54] AWNING

[76] Inventor: Viktor Lohausen, Goldmuhlestrasse 9912, 7032 Sindelfingen, Fed. Rep. of Germany

[21] Appl. No.: 533,754

[22] Filed: Sep. 19, 1983

[51] Int. Cl.[3] ..... E04F 10/06

[52] U.S. Cl. ..... 160/22

[58] Field of Search ..... 160/22, 26, 68, 70

[56] References Cited

U.S. PATENT DOCUMENTS 2,740,470 4/1956 D'Azzo ..... 160/70

3,782,443 1/1974 Clauss et al. ..... 160/22

FOREIGN PATENT DOCUMENTS 2752807 5/1979 Fed. Rep. of Germany ..... 160/22

*Primary Examiner*—Peter M. Caun

[57] ABSTRACT

An awning with a take-up arrangement is mounted to the wall of a building. The take-up arrangement has a fabric roll on which the awning fabric can be rolled, with at least one hinged bracket which has a top bracket arm and a bottom bracket arm connected to one another in hinge fashion at a pivot. A swivel joint member is joined to the top bracket arm and can be tilted around a bottom horizontal axis. A setter is provided for the tilt angle of the swivel joint. A drop bar is joined to the bottom bracket arm and to which one end of the awning cloth is fastened. A fabric guide is provided for glide-propping the awning cloth in the area above the swivel joint. A continuous center carrier is located in fixed position in a longitudinal direction parallel to the fabric roll, and has a free end and another end. The hinged joint member is attached in tiltable fashion on the fixed center carrier. The fabric guide is located on the free end of the center carrier and facing away from the base member. The setter is located with one end at the free end of the center carrier and with its other end on the hinged joint member. The upper bracket arm has a substantially rectangular cross section. The lower bracket arm has a U-profile cross section, with outer shanks which are spaced apart slightly larger than the cross section of the upper bracket arm. The hinged joint member has a U-profile cross section comprising a base shank with outer shanks, which are spaced apart larger than the cross section of the U-profile lower bracket arm. When the hinged bracket arrangement is in a retracted position, the lower bracket arm overlaps the upper bracket arm and the hinged joint member overlaps the lower bracket arm adjacent to the center carrier, in a form-fitting manner.

42 Claims, 4 Drawing Figures

AWNING

The invention concerns an awning with a take-up arrangement and a fabric roll on which the awning fabric can be rolled, with at least one hinged bracket which exhibits a top bracket and a bottom bracket, connected to one another in hinge fashion, with a swivel joint, which is joined to the top bracket and can be tilted around a bottom horizontal axis, with a setter for the tilt angle of the swivel joint, with a catch rod, to which the bottom bracket is joined and to which one end of the awning cloth is fastened, and with a fabric guide for glide-propping the awning cloth in the area above the swivel joint.

BACKGROUND OF THE INVENTION

In a prior art awning of this kind, the swivel joint is tiltably mounted, through appropriate profile design on the bottom directly on the base bar of the cassette-type take-up. As a result of this hinged bearing design and arrangement a certain sluggishness cannot be avoided particularly for a larger awning, whereas the function of the awning is impaired, particularly by wind attacking from the outside. For this purpose, the base bar as well as the rear wall and a part of the top wall of the take-up arrangement are embodied as a double-walled hollow body so that a certain stiffening effect is achieved. Such a hollow body design of the take-up arrangement is cumbersome to fabricate and entails high tool costs. In addition, the take-up arrangement has rather large height and width dimensions due to the double-walled hollow body design. As a result of these relatively large awning dimensions, installation on buildings requires a correspondingly large area and free space available under the awning is curtailed. Another disadvantage is that the setter for the tipping gradient is located in the area between the fabric rod and the hinged bracket, so that additional space is required. The fabric guide for the glide prop of the awning fabric is provided exclusively on the top of the hinged bracket, so that the awning fabric is glide-propped only in this area. In addition, the fabric guide is moved back and forth according to the tilting movement of the hinged bracket, so that, depending on the tilt gradient of the hinged bracket, the awning fabric is exposed to variable glide friction loads and, as a result, the awning fabric can become prematurely worn. In addition, it is also disadvantageous that, on account of the double-walled hollow body design of the bottom bracket and of the drop bar, a large amount of space is required when the hinged bracket is pulled in, so that the awning has large exterior dimensions and, particularly in the rolled-up state, a relatively large area is required for the assembly elements, the free area in front of the awning is curtailed and, finally, overall visual effect is impaired. A prior art awning or the kind described is shown in U.S. Pat. No. 3,782,443, which issued on Jan. 1, 1974 to Manfred Clauss, et. al.

OBJECTS AND STATEMENTS OF THE INVENTION

Accordingly, the object of the invention is to improve an awning of the above specified type in such a way that the stability is increased, and the structural dimensions are reduced as well as the fabrication costs, and an extensively constant glide prop of the awning fabric is achieved.

According to the invention, this problem is solved in that a continuous central carrier is permanently located in tiltable fashion on the base bar of the take-up arrangement in longitudinal direction parallel to the fabric roller, that the hinged bracket is mounted in tilting fashion on the fixed central carrier, that the fabric guide is located on the free end part of the central carrier turned away from the base bar, and the setter with one end is located on the end part and with the other end on the hinged joint, that the lower bracket is formed in U-profile in cross section, the inside cross section between the shanks is slightly larger than the cross section of the essentially rectangular lower bracket, and that the drop bar is also fashioned as U-profile, the inside diameter of which between the shanks is slightly larger than the cross section of the U-shaped lower bracket, whereas, for retracted hinged bracket, the lower bracket overlaps the upper bracket and the drop bar overlaps the lower bracket in parallel next to the central carrier in a form-locked manner.

The following special advantages are achieved through the invention:

1. With the narrow central carrier, arranged continuously in longitudinal direction of the take-up arrangement on its base rod between the fabric roller and the letting-out elements, a high rigidity is achieved, so that even for a large awning and strong, externally attacking forces a reliable strength is provided by simple means.

2. The take-up arrangement can be fabricated from a relatively thin single wall. This represents a savings in material. In addition, the fabrication of the take-up arrangement requires only relatively simple tools, so that in this case also a significant cost savings is achieved.

3. The take-up arrangement is only slightly higher than the diameter of the fabric roller, so that an extremely low mounting height is achieved.

4. Since the setter is no longer located between the hinged bracket and the fabric roller, but is located in the area above the hinged bracket, then the outer dimensions of the horizontal width of the awning are also reduced.

5. The outer dimensions are considerably reduced further as a result of the U-shaped design of the lower bracket and of the drop bar and of the interlocking of the letting-out elements.

6. A uniform, constant glide prop is provided over the complete width of the awning fabric according to the invention through the arrangement of the fabric guide on the top end of the central carrier. This provides for a careful guiding of the awning fabric during the retraction and the letting out of the awning and a long life of the awning fabric.

7. As a result of the pivot-bearing mounting of the hinged bracket directly on the central carrier, the forces are directly imparted to the central carrier and are directly absorbed by it.

8. The fabric guide provides that the awning fabric is stretched evenly and wrinkle-free when the awning is extended.

9. The free space under the awning is enlarged as a result of the small installation height.

10. In addition, as a result of the completely flat embodiment of the awning a larger application range is achieved, since the awning according to the invention can be installed in very unfavorable structural situations in a very small space, for example, under a balcony base or close above the blind frame of a window.

The center carrier has a base part and the base member of the take-up arrangement has a groove, the base part of the center carrier being removably secured therein. Through these characteristics, simple mounting and secure fastening of the center carrier on the base bar are achieved.

The base part of the center carrier has an insert groove and the hinged joint member has a bearing block with a dovetail bar which is fitted in the insert groove. Through these characteristics, stable and exactly adaptable fastening of the swivel bearing on the center carrier are achieved.

The center carrier has a base part with a bearing block thereon, and the hinged joint member has a horizontal tilt axis which is located in the bearing block at the base part of the fixed center carrier. Through these characteristics, a good force flow with short transmission paths for accomodating the forces attaching in the region of the horizontal tilt axis is achieved.

The free end of center carrier facing away from the base part is shaped in an arc of a circle which provides a fabric guide on the top side. Through this characteristic, a frictionless glide prop is achieved.

The center carrier has an arc-shaped end having a longitudinal groove and a bearing part fitted in the longitudinal groove, the setter being pivotably and removably connected to the bearing part. Through these characteristics, easy and readily adaptable fastening of the setter on the center carrier is achieved.

The hinged joint member has a top part at a distance from the bearing block and the end of the setter on the hinged joint member faces away from the bearing part and is arranged pivotably on the top part. Through these characteristics, an advantageous swivel fastening is achieved in the top area of the swivel bearing.

The bearing block associated with the hinged joint member and the bearing part associated with the setter are substantially identical. Through these characteristics, a cost saving is achieved in the fabrication as well as in storage and installation.

The length of the outer shanks of the U-shaped lower bracket arm overlapping the upper bracket arm is approximately equal to the width of the upper bracket arm and the space between the two brackets. Through these characteristics, it is achieved that, for retracted hinged bracket, the lower bracket completely overlaps the upper bracket.

Pivot bearing parts are arranged between the lower bracket arm and the upper bracket arm. Through this characteristic, a more advantageous hinged bearing between the lower bracket and the upper bracket is achieved.

The height of the lower bracket arm is slightly smaller than the height of the hinged joint member and the outer shanks of the lower bracket arm are overlapped by the hinged joint member. Through these characteristics, a box-like overlap of lower bracket and hinged joint is achieved.

The U-shaped drop bar has a base shank, the length of the outer shanks of the U-shaped drop bar which overlap the lower bracket arm is approximately half the width of the lower bracket arm and a narrow space between the base shank of the drop bar and the lower bracket arm. Through these characteristics, it is achieved that for retracted joint bracket the drop bar covers the lower bracket and the upper bracket in a space-saving manner.

Bearing parts are located between the outer shanks of the drop bar and the outer shanks of the lower bracket arm, over which the lower bracket arm is pivotably connected, around an axis, with the drop bar. Through this characteristic, an advantageous pivot bearing with a long life is achieved in the area of the pivot bearing of the lower bracket on the drop bar.

A lower bearing block for the hinged joint member is secured to the center carrier, wherein the outer shank of the drop bar extends in the plane of the lower bearing block or of the free end of the center carrier. Through this characteristic an extensive height match of the drop bar to the height distance between the bottom bearing block and the upper end part of the center carrier is achieved.

The drop bar has a fastening channel on the top outer shank in the area of the base shank. Through this characteristic, an advantageous fastening option, for example, for an awning flounce, is achieved.

The drop bar has a holding channel on the lower outer shank in the area of the base shank. Through this characteristic, an additional fastening feature for the optional arrangement of an awning flounce or the like is obtained.

A fastening groove is located in the free end area of each of the outer shanks. Through this characteristic, two further fastening options are achieved, so that the end of the awning cloth can be fastened in the mounting groove of the upper outer shank and a decorative panel or the like can be fastened in the lower mounting groove.

The fastening grooves in the two outer shanks of the drop bar are substantially the same. Through this characteristic, on the basis of an extensively identical design of the outer shanks, a simplification of the fabrication tool as well as a cost reduction in the drop bar fabrication are achieved.

The U-shaped lower bracket arm is symmetrical with respect to a plane extending parallel to the free shanks and between them. Through this characteristic, a diversified application of the lower bracket and simplified assembly are achieved, since the lower bracket can be easily installed the other way around, so that the lower free shank extends upward and the upper free shank extends downward.

The fixed center carrier has a base part and the height of the fixed center carrier from the base part to the fabric guide is approximately the height of the drop bar in the plane of the base shank. Through these characteristics, an extensive height match between the center carrier and the crop bar is achieved.

A fastening channel, a holding channel, and fastening grooves of the drop bar are substantially the same in cross section. Through these characteristics, an essentially uniform embodiment of the fastening take-ups on the drop bar is achieved, resulting in a cost savings in the fabrication of the production tool and rationalization options for attaching additional parts to the drop bar.

The end of the awning cloth can be fastened in the fastening groove in the free end of the top outer shank, the top fastening channel, the lower holding channel as well as the fastening groove in the free end of the lower outer shank on the drop bar. Through this characteristic, different mounting options are achieved for fastening the awning cloth on the drop bar. For example, if the end of the awning cloth is fastened in the lower fastening groove on the free end of the outer shank of the drop bar, then the drop bar is completely covered on the outside, so that almost no metal parts are visible from the outside.

The drop bar has holding channels and an antiglare panel can be attached on the outside of the base shank of the drop bar, the antiglare panel having holding strips for fitting in the holding channels of the drop bar. Through these characteristics, it is possible to achieve a diverse optical design option by attaching an insert panel, which is of different colors and of different, preferably thin, materials.

A shade arrangement is attached on the outside of base shank of the drop bar. Through this characteristic, additional coverage against solar radiation or strangers looking in is provided. For this purpose the shade of the roll arrangement in the front on the drop bar of the awning is pulled down and can be continually arrested in almost every arbitrary pulled-out position.

The drop bar has a top fastening channel and a lower fastening channel and comprising a shade arrangement having holding strips for securing the shade arrangement to the top fastening channel and the lower fastening channel of the drop bar. Through these characteristics, an advantageous fastening of the shade arrangement on the drop bar is achieved.

The shade arrangement has a rear wall adjoining the base shank of the drop bar, the height of which is approximately equal or slightly smaller than the height of the base shank. Through this characteristic, an advantageous height match of the shade arrangement to the height of the drop bar is achieved, so that an attractive exterior look is obtained.

The shade arrangement has a shade take-up which is located in the lower area of the base shank and in front of it. Through this characteristic, an advantageous arrangement of the shade in the bottom region of the drop bar is achieved, so that the free end of the shade is easily reached for pulling down.

The shade take-up has an opening for pulling out a shade, which is substantially located in the plane of the lower outer shank of the drop bar. Through this characteristic, a uniform, attractively designed under-view in the region of the drop bar is achieved.

The shade arrangement has a rear wall adjoining the base shank of the drop bar and a cover extending obliquely upward to the top end of the rear wall from the shade take-up. Through these characteristics, a material saving embodiment of the shade arrangement and an advantageous slope for rain water drainage as well as an attractive design are achieved.

A wall of the shade take-up is connected with the back wall and the cover. Through this characteristic, a high stiffness of the shade arrangement is achieved, so that it can be fabricated of extremely thin material resulting in a cost reduction.

At least one brush is arranged in the area of the opening of the shade arrangement. Through this characteristic, an elastic slide of the shade is achieved during retraction and lowering and cleaning of the shade surface.

The shade arrangement has at least one mounting slit for a flounce. Through this characteristic, the option of attaching a flounce to the shade arrangement is achieved.

Mounting slits are formed in a lower wall of the shade arrangement near the rear wall and near an outer wall and located at a distance from it. Through this characteristic, an optional fastening feature for a flounce on the shade arrangement is achieved. Two flounces can also be fastened in the two mounting slits of the shade arrangement.

A mounting slit is formed in the top end area of the oblique cover. Through this characteristic, a further fastening option for a flounce is achieved. In this case, the flounce would cover practically the complete shade arrangement on the outside.

A substantially U-shaped rain gutter is fastened on the shade arrangement in the mounting slit of the lower wall near the outer wall and located in front of it. Through this characteristic, it is achieved that rain water does not drop off on the outside of the shade arrangement, but is guided off on the sides.

A cloth brush is located at the top and in front of an opening area of the take-up arrangement. Through this characteristic, cleaning of the awning cloth is achieved. The cleaning area is located in such an advantageous manner that no dirt penetrates into the cassette when the awning is retracted.

The cloth brush is mounted in a height-adjustable manner. Through this characteristic, a match of the cloth brush to various tilt angles of the awning cloth during extension and retraction of the awning is achieved.

The cloth brush is mounted on a cover of the take-up arrangement. Through this characteristic, simple fastening of the cloth brush without additional mountings or the like is achieved.

The take-up arrangement has a cover and cloth brush is mounted in an undercut channel of the cover. Through this characteristic, a simple bearing design for the cloth brush on the cassette cover is achieved.

The cloth brush is pivotable together with an end part of the cover around a horizontal longitudinal axis. Through this characteristic, a simple height adjustment of the cloth brush to the awning cloth is achieved. A uniform contact or brush force on the surface of the awning cloth is essentially achieved through the weight of the cloth brush.

A rain gutter bar is located on the undercut channel of the cover. Through this characteristic, a sideways run-off of rain water is achieved on top over and in front of the opening area of the cassette-shaped awning.

Corner areas on the upper and lower bracket arms have seals fastened thereon. Through this characteristic, it is achieved that on retraction of the awning friction damage between the upper bracket and the lower bracket and/or drop bar does not occur. The preferably slightly protruding seals are fabricated of an elastic material and, in the case of a displacement, cause the parts to come together softly. As a result, any metal flapping housings exposed to winds are avoided.

DESCRIPTION OF THE DRAWINGS

The invention is explained in detail below with reference to a particularly preferred example of an embodiment as shown in the drawings. These show.

Figure 4:
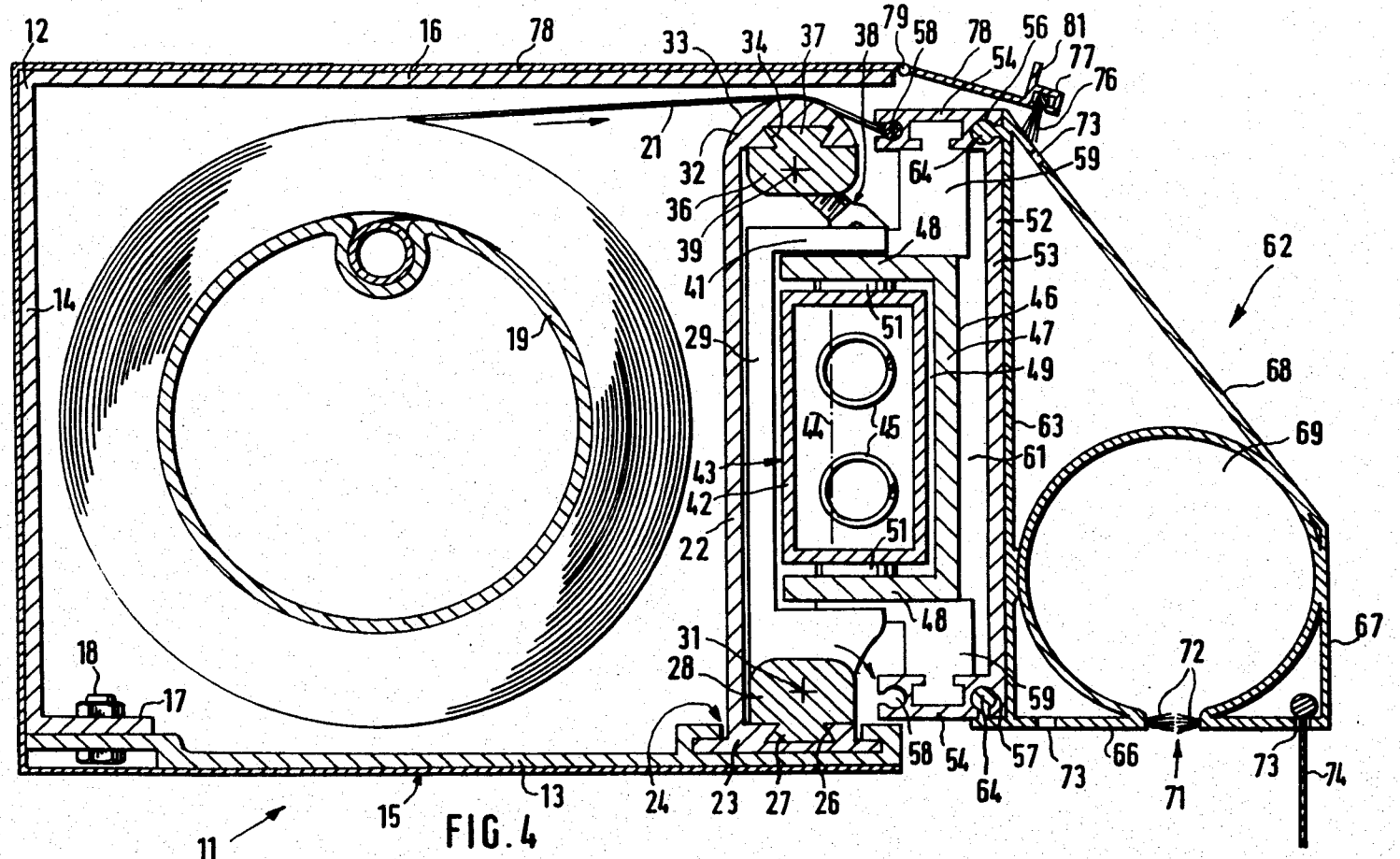

The awning according to the invention will first be described with reference to FIG. 4.

As used in this specification, the term "shank(s)" means wall(s). The terms "holding" and "fastening" are used interchangeably, and the terms "groove(s)" and "channel(s)" are used interchangeably.

DETAILED DESCRIPTION

The awning 11 according to the invention exhibits a take-up arrangement 12 in the form of a cassette, which is equipped with a base bar 13, an angular holder with vertical rear wall 14, and horizontal cover wall 16. A short fastening shank 17 is bent off on rear wall 14, which is connected via screw 18 to the end of base bar 13 bent off in step-shaped fashion. Take-up arrangement 12 may exhibit in rear wall 14 and in cover wall 16 holes or similar openings for the fastening on a vertical house wall and/or on a structure roof or can be mounted with standard two-part fastening brackets in the usual manner on a structure. In the displayed exemplified embodiment take-up arrangement 12 is housed in a cassette, which consists of a weatherproof material such as thin aluminum foil. Cassette 15 can be constructed of a single or of several foils.

A cloth bar 19 rests in take-up arrangement 12, on which an awning cloth 21 is rolled. Awning cloth 21 can be rolled off cloth bar 19 in the direction of the arrow. The outer height of take-up arrangement 12 is only slightly larger than the diameter of cloth bar 19 with the rolled-on awning cloth 21, so that an extremely small structural height is obtained.

A narrow essentially flat rectangular center carrier 22 is located in upright standing fashion directly next to the outer diameter of cloth bar 19. The space in take-up arrangement 12 in the horizontal width direction between rear wall 12 and center carrier 22 is also only slightly larger than the outer diameter of cloth bar 19. As a result, the dimensions of take-up arrangement 12 are extremely small also in this horizontal width direction.

Center carrier 22 has a base part 23, which is fastened in removable manner in an undercut groove 24 of base rod 23. Base part 23 has a dovetailed undercut insert groove 26 where a dovetailed bar 27 of bearing block 28 is removably fastened. A hinged joint 29 is mounted on bearing block 28 in pivoting fashion around a horizontal tilt axis 31 in the direction of the arrow. On a top end part 33 of center carrier 22, turned away from end part 32, a cloth guide 33 is formed with a cross section of an arc of a circle. A dovetailed undercut longitudinal groove 34, like insert groove 26, is formed in fabric guide 33. A bearing part 36 with dovetailed rod attachment 37 is removably fastened in longitudinal groove 34. A setter 38, pivotable around a horizontal 39, is attached on bearing part 36. Setter 38 is pivotably attached to top part 41 of pivot bearing 29 and thus, in the manner which can be seen from FIGS. 2 and 3, can be extended in the direction of the arrow, so that the degree of tilt angle of hinged joint 29 is adjustable. Setter 38 can be designed in the form of a setscrew or also as a telescopic component and/or as pneumatic or hydraulic cylinder valve. The drawing shows that bearing block 28 of hinged joint 29 and bearing part 36 of setter 38 are designed with the same cross section.

The upper bracket 42 of hinged bracket 43 is attached in pivotable fashion around a vertical axis 44 on hinged joint 29. Upper bracket 42 is designed as a hollow body with rectangular cross section, which can also be designed with rounded corners or as an oval, and houses tension springs, telescope valves or similar force accommodating elements (45) for extending and retracting awning 11.

Lower bracket 46 of foldable hinged joint 43 overlaps upper bracket 42 in form-locked fashion. Lower bracket 46 exhibits a base wall 47 as well as two free shanks 48 and is designed U-shaped in cross section. The height of lower bracket 46 is slightly smaller than the outer height of hinged joint 29 and free shanks 48 are overlapped by hinged joint 29. The length of free shanks 48 is dimensioned in such a way that they completely overlap upper bracket 42 on the top and on the bottom and that a small slit 49 is formed between upper bracket 42 and base wall 47.

Pivot bearings 51 are located between lower bracket 46 and upper bracket 42, which are a part of the hinge joint between the two brackets. Lower bracket 46 is formed in mirror symmetry to a plane, which extends in the center between the free shanks in parallel to them.

Hinged joint 43 is, in turn, overlapped by a U-shaped drop bar 52. Drop bar 52 exhibits a base shank 53 as well as two free outer shanks 54. The total height of the drop bar 52 in the plane of base shank 53 is only slightly smaller than the height of the fixed center carrier 22. However, drop bar 52 can certainly be made higher than the center carrier 22. A fastening channel is formed in the area of the base shank 53 on the top outer shank 54 of drop bar 52. A holding channel 57 is also formed in the area of base shank 53 on the bottom outer shank 54, which is designed exactly as the fastening channel 56 but is open downward.

Figure 1:
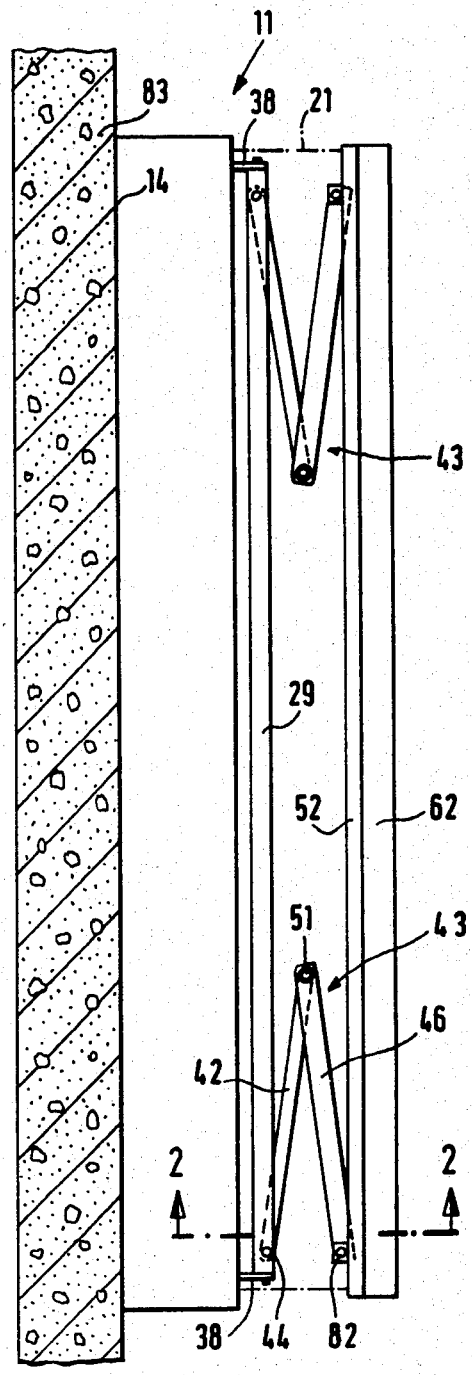
FIG. 1 a view from above of an awning according to the invention fastened to a wall, shown schematically simplified and in a slightly open position, FIG. 2 a partial section of the awning in the plane 2—2 of FIG. 1, only the front part of the awning being shown on a 1:1 scale, FIG. 3 a partial view in the direction of the arrow 3 according to FIG. 2, FIG. 4 a sectional view of the whole awning, corresponding to FIG. 2, but in the closed state.

Lower bracket 46 is pivotably attached on outer shanks 54 of the drop bar, whereas bearings 59 are located between outer shanks 54 and free shanks 48 of lower bracket 46, over which the lower bracket 46 with the drop bar 52 is connected pivotably about an axis of a shaft 82 (FIG. 1). The length of outer shanks 54 is dimensioned in such a way that the free shanks 48 of lower bracket 46 overlap to about the center. A slit separation 61 is present between base wall 47 and base shank 53, which is so narrow that, as a whole, a form-locked, compact embodiment is obtained. The top outer shank 54 of drop bar 52 extends in the plane of end part 32 formed on center carrier 22, whereas the lower outer shank 54 extends in the plane of the bearing block 28 also fastened on center carrier 22.

The free outer shanks 54, which exhibit in the center area an undercut channel for accommodating bearings 59, are designed essentially identically. In the free end area of each of the outer shanks 54 there is a fastening groove 58, the opening of which faces in the direction to center carrier 22. However, the openings of fastening grooves 58 can also be arranged facing in another direction, e.g., facing up or facing down. Fastening grooves 58, fastening channel 56, and holding channel 57 of drop bar 52 are designed with the same outer cross section. In the shown exemplified embodiment the end of awning cloth 21 is fastened in the top fastening groove 58 of drop bar 52. However, it is also possible to pull the awning cloth 21 around drop bar 52 and to anchor it in the lower fastening groove 58. In this case drop bar 52 would be completely covered by awning cloth 21. In addition, awning cloth 21 can be optionally arranged in top fastening channel 56 or in lower holding channel 57. If the awning cloth 21 is arranged in the top fastening groove 58 or in the top fastening channel 56, then a flounce can be located in the bottom fastening groove 58 or in the bottom holding channel 57. Further, an antiglare panel can be arranged on the outside of base shank 53 of drop bar 52. This antiglare panel would have guide straps, which are engaged in fastening channel 56 and holding channel 57. Such an antiglare panel would be advantageous for decorative purposes and could be fabricated of a thin material of many colors at low cost.

Awning 11 of the present exemplified embodiment exhibits a shade arrangement 62. This shade arrangement 62 is located with a rear wall 63 on base shank 53 of drop bar 52 and is fastened with a holding strap 64 each on the top fastening channel 56 and the bottom fastening channel 57. The height of rear wall 63 is dimensioned in such a way that it equals the height of base shank 53.

In addition, shade arrangement 62 exhibits a bottom partition 66 for external screening, an outer partition 67 extending in parallel to the rear wall 63, as well as a cover 68. The cover 68 runs from the top end of rear wall 63 diagonally sloping downward with respect to the outer partition. A shade take-up 69 is located in the lower area of shade arrangement 62. The wall of shade take-up 69 is uniformly connected with rear wall 63 and cover 68.

The bottom partition of shade arrangement 62 essentially extends in the plane of the lower outer shank 54 of drop bar 52 and in its center area has an opening 71 for the shade take-up 69. In the area of this opening 71 there are arranged brushes 72 on both sides, between which the shade is guided. In addition, holding slits 73 are located in the bottom partition 66, one of which is located near rear wall 63 and the other near outer wall 67. A flounce 74 is attached in holding slit 73 on the outer wall 67, which could also be fastened in the other holding slit 73 next to the rear wall 63. A U-shaped rain gutter could be also expediently fastened in holding slit 73 next to outer wall 67 instead of flounce 74. A further holding slit 73 is located in the top end area of the oblique cover 68, so that a flounce could also be fastened here which would cover the shade arrangement 62 from the outside.

A cloth brush 76 is located on the top in front of the opening area of take-up arrangement 12. This cloth brush 76 is located in an undercut-channel 77 of cover 78 of cassette 15. The end part of cover 78 is pivotable around a horizontal longitudinal axis 79 with cloth brush 76 and extends to the front slightly obliquely. The pivotable attachment of cloth brush 76 allows height adjustment, which automatically matches to the prevailing slope during extension of awning cloth 21. In addition, a rain gutter 81 is located on undercut-channel 77, which drains the rain water to the side.

The cloth brush 76 is located on the plotted site, so that brushed-off dirt is delivered to an area outside cloth 21.

As a result of the described construction, the invention can provide the two internally located springs 45.

The springs conventionally serve to produce a prestress which tends to extend the joint arm 43. FIG. 1 shows the awning with its rear wall 14 attached to a house wall 83. When, with the awning closed as in FIG. 4, the fabric shaft 19 is turned clockwise and the awning cloth 21 is thus unwound, the fall rod 52 can go out to the right. The fall rod 52 is then turned to the right by the joint arms 43 which are supported by their vertical axes 44 on the pivot joint 29. This at first hence remains in the vertical position shown in FIG. 4. However, the further the fall rod 52 displaces from the horizontal tilting axis 31, the greater becomes the influence of its weight. It finally, reaches a position in which the weight is preponderant and the pivot joint 29 tilts into the titled position visible in FIG. 2.

Figure 2:
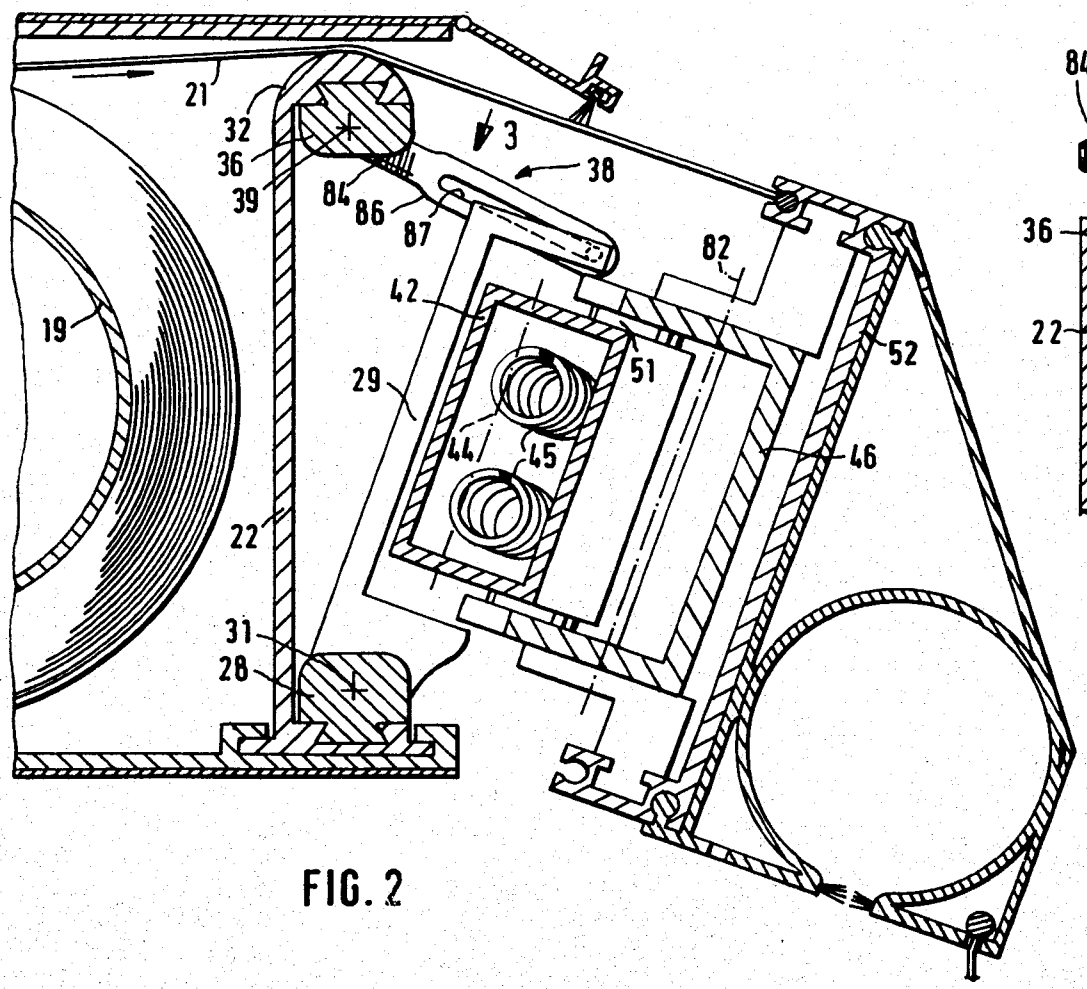

Because the sectional plane of this view lies in front of the shafts 44 and 82, these are shown in FIG. 2 only by dash-dot lines. However, the rotary mounting part 51 which connects the upper arm 42 to the lower arm 46 lies in the direction of view. The awning 11 shown in the example is provided with two joint arms 43. The awning cloth 21 is shown dashed in FIG. 1, since otherwise it would cover the joint arms.

An adjuster 38 is fitted on each end side of the pivot joint 29.

Figure 3:
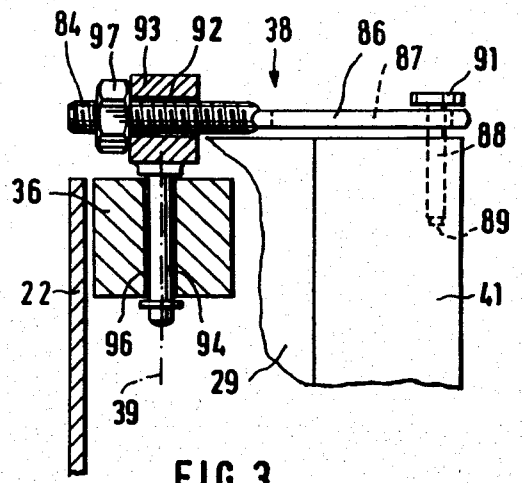

An example of an adjuster 38 will now be described in more detail with reference to FIG. 3. It comprises a threaded rod 84 adjoined by a flat extension 86 which has a slotted hole 87. The slotted hole has passing through it a bolt 88 which is driven home into an end bore 89 in the upper part 41 of the pivot joint 29. A widened head 91 of the bolt 88 lies externally near the extension 86 and thus prevents this slipping off the bolt 88. The threaded rod 84 passes through a through bore 92 of a mounting head 93, which is pivotably mounted with its mounting pin 94 in a bore 96 of the mounting part 36, to pivot about the horizontal axis 39. The threaded rod 84 carries a nut 97 which is supported on the mounting head 93.

As shown in FIG. 2, the pivot joint 29 can pivot out between its perpendicular, folded-in position (FIG. 4) into the tilted position shown, in which the bolt 88 is movable in the slotted hole 87. The end position of tilting can be adjusted by means of the nut 97. Because the adjusters are arranged on the end side, the adjustment can be carried out without any problem.

I claim:

1. An awning take-up arrangement, having a fabric roll on which an awning fabric can be wound, at least one hinged bracket arrangement movable between an extended position and a retracted position, having an upper arm and a lower arm connected to one another in hinged fashion, a hinged joint member to which the upper bracket arm is attached and which is tiltable around a horizontal axis, a setter with two ends for the tilt angle of the hinged joint member, a drop bar to which the lower bracket arm is attached and to which one end of the awning fabric is fastened, a fabric guide for glide supporting the awning fabric in the area above the hinged joint member, and the improvement comprising:

a base member on the take-up arrangement, a continuous center carrier located in fixed position on the base member in a longitudinal direction parallel to the fabric roll, and having a free end and another end, the hinged joint member being attached in tiltable fashion on the fixed center carrier, the fabric guide being located on the free end of the center carrier and facing away from the base member, the setter being located with one end at the free end of the center carrier and with its other end on the hinged joint member, the upper bracket arm having a substantially rectangular cross section, the lower bracket arm having a U-profile cross section, with outer shanks which are spaced apart slightly larger than the cross section of the upper bracket arm, the hinged joint member having a U-profile cross section comprising a base shank with outer shanks which are spaced apart larger than the cross section of the U-profile lower bracket arm, wherein, when the hinged bracket arrangement is in a retracted position, the lower bracket arm overlaps the upper bracket arm and the hinged joint member overlaps the lower bracket arm adjacent to the center carrier, in a form-fitting manner.

2. Awning according to claim 1 wherein the center carrier has a base part and the base member of the take-up arrangement has a groove, the base part of the center carrier being removably secured therein.

3. Awning according to claim 2 wherein the base part of the center carrier has an insert groove and the hinged joint member has a bearing block with a dovetail bar which is fitted in the insert groove.

4. Awning according to claim 1, in which the center carrier has a base part with a bearing block thereon, and the hinged joint member has a horizontal tilt axis which is located in the bearing block at the base part of the fixed center carrier.

5. Awning according to claim 4 wherein the center carrier has an arc-shaped end having a longitudinal groove and a bearing part fitted in the longitudinal groove, the setter being pivotably and removably connected to the bearing part.

6. Awning according to claim 5 wherein the hinged joint member has a top part at a distance from the bearing block and the end of the setter on the hinged joint member faces away from the bearing part and is arranged pivotably on the top part.

7. Awning according to claim 5 wherein the bearing block associated with the hinged joint member and the bearing part associated with the setter are substantially identical.

8. Awning according to claim 1 wherein the free end of center carrier facing away from the base part is shaped in an arc of a circle which provides a fabric guide on the top side.

9. Awning according to claim 1 wherein the length of the outer shanks of the U-shaped lower bracket arm overlapping the upper bracket arm is approximately equal to the width of the upper bracket arm and the space between the two brackets.

10. Awning according to claim 1 comprising pivot bearing parts arranged between the lower bracket arm and the upper bracket arm.

11. Awning according to claim 1 wherein the height of the lower bracket arm is slightly smaller than the height of the hinged joint member and the outer shanks of the lower bracket arm are overlapped by the hinged joint member.

12. Awning according to claim 1 wherein the U-shaped drop bar has a base shank the length of the outer shanks of the U-shaped drop bar which overlap the lower bracket arm is approximately half the width of the lower bracket arm and a narrow space between the base shank of the drop bar and the lower bracket arm.

13. Awning according to claim 1 comprising bearing parts located between the outer shanks of the drop bar and the outer shanks of the lower bracket arm, over which the lower bracket arm is pivotably connected, around an axis, with the drop bar.

14. Awning according to claim 1 comprising a lower bearing block for the hinged joint member secured to the center carrier, wherein the outer shank of the drop bar extends in the plane of the lower bearing block or of the free end of the center carrier.

15. Awning according to claim 1 wherein the drop bar has a fastening channel on the top outer shank in the area of the base shank.

16. Awning according to claim 1 wherein the drop bar has a holding channel on the lower outer shank in the area of the base shank.

17. Awning according to claim 1 wherein a fastening groove is located in the free end area of each of the outer shanks.

18. Awning according to claim 17 wherein the fastening grooves in the two outer shanks of the drop bar are substantially the same.

19. Awning according to any one of claims 15-17 or 18 comprise ing a fastening channel, a holding channel, and fastening grooves of the drop bar which are substantially the same in cross section.

20. Awning according to claim 21 wherein the end of the awning cloth can be fastened in the fastening groove in the free end of the top outer shank, the top fastening channel, the lower holding channel as well as the fastening groove in the free end of the lower outer shank on the drop bar.

21. Awning according to claim 1 wherein the U-shaped lower bracket arm is symmetrical with respect to a plane extending parallel to the free shanks and between them.

22. Awning according to claim 1 wherein the fixed center carrier has a base part and the height of the fixed center carrier from the base part to the fabric guide is approximately the height of the drop bar in the plane of the base shank.

23. Awning according to claim 1 wherein the drop bar has holding channels and an antiglare panel can be attached on the outside of the base shank of the drop bar, the antiglare panel having holding strips for fitting in the holding channels of the drop bar.

24. Awning according to claim 1 comprising a shade arrangement attached on the outside of base shank of the drop bar.

25. Awning according to claim 24 wherein the drop bar has a top fastening channel and a lower fastening channel and comprising a shade arrangement having holding strips for securing the shade arrangement to the top fastening channel and the lower fastening channel of the drop bar.

26. Awning according to claim 25 wherein the shade arrangement has a rear wall adjoining the base shank of the drop bar, the height of which is approximately equal or slightly smaller than the height of the base shank.

27. Awning according to any one of the claims 24, 25 or 26 wherein the shade arrangement has a shade take-up which is located in the lower area of the base shank and in front of it.

28. Awning according to claim 27 wherein the shade take-up has an opening for pulling out a shade, which is substantially located in the plane of the lower outer shank of the drop bar.

29. Awning according to claim 27 wherein the shade arrangement has a rear wall adjoining the base shank of the drop bar and a cover extending obliquely upward to the top end of the rear wall from the shade take-up.

30. Awning according to claim 29 comprising a wall of the shade take-up connected with the rear wall and the cover.

31. Awning according to claim 27 comprising a mounting slit formed in the top end area of the oblique cover.

32. Awning according to and one of the claims 24, 25 or 26 comprising at least one brush arranged in the area of the opening of the shade arrangement.

33. Awning according to any one of the claims 24, 25 or 26 wherein the shade arrangement has at least one mounting slit for a flounce.

34. Awning according to any one of the claims 24, 25 or 26 comprising mounting slits formed in a lower wall of the shade arrangement near the rear wall and near an outer wall and located at a distance from it.

35. Awning according to claim 34 comprising a substantially U-shaped rain gutter fastened on the shade arrangement in the mounting slit of the lower wall near the outer wall and located in front of it.

36. Awning according to claim 1 comprising a cloth brush located at the top and in front of an opening area of the take-up arrangement.

37. Awning according to claim 36 wherein the cloth brush is mounted in a height-adjustable manner.

38. Awning according to claim 36 wherein the cloth brush is mounted on a cover of the take-up arrangement.

39. Awning according to claim 38 wherein the take-up arrangement has a cover and cloth brush is mounted in an undercut channel of the cover.

40. Awning according to claim 39 wherein the cloth brush is pivotable together with an end part of the cover around a horizontal longitudinal axis.

41. Awning according to either of the claims 39 or 40 comprising a rain gutter bar located on the undercut channel of the cover.

42. Awning according to claim 1 comprising corner areas on the upper and lower bracket arms and seals fastened on the corner areas of the upper bracket arm and/or the lower bracket arm.

* * * * *